US007014076B2

(12) United States Patent
Minard et al.

(10) Patent No.: US 7,014,076 B2
(45) Date of Patent: Mar. 21, 2006

(54) SYRUP DELIVERY SYSTEM

(75) Inventors: James J. Minard, South Beloit, IL (US); Pete McNamee, Beloit, WI (US); Mark Bush, Rockton, IL (US); Jon Peter Gilchrist, Lake Zurich, IL (US)

(73) Assignee: Carrier Commercial Registration, Inc., Charlotte, NC (US)

( * ) Notice: Subject to any disclaimer, the term of this patent is extended or adjusted under 35 U.S.C. 154(b) by 344 days.

(21) Appl. No.: 10/272,233

(22) Filed: Oct. 15, 2002

(65) Prior Publication Data

US 2004/0069804 A1 Apr. 15, 2004

(51) Int. Cl.
*B67D 3/00* (2006.01)

(52) U.S. Cl. ..... 222/504; 251/63.6; 137/102

(58) Field of Classification Search ..... 222/504, 222/505; 251/62–63.6; 137/102, 107, 613
See application file for complete search history.

(56) References Cited

U.S. PATENT DOCUMENTS 3,084,707 A * 4/1963 Frye ..... 137/102
3,245,426 A * 4/1966 Kreuter et al. ..... 137/112
3,633,605 A * 1/1972 Smith ..... 137/113
3,722,526 A * 3/1973 Henningsson ..... 137/107
4,226,343 A * 10/1980 Fling ..... 222/504
4,381,099 A * 4/1983 Knedlik ..... 251/14
4,977,920 A * 12/1990 Oberdorfer ..... 137/218
5,176,658 A * 1/1993 Ranford ..... 604/247

* cited by examiner

*Primary Examiner*—Michael Mar
*Assistant Examiner*—Melvin A Cartagena
(74) *Attorney, Agent, or Firm*—Carlson, Gaskey & Olds

(57) ABSTRACT

A syrup delivery system delivers flavored syrup. A solenoid introduces air into the system and into an inlet of an exhaust diverter including a flexible diaphragm. The air exits the exhaust diverter through an outlet for entry into a syrup valve that dispenses the syrup. After dispensing of the syrup, the solenoid blocks air from entering the system. The air from the syrup valve reenters the exhaust diverter through the outlet. The air exits the exhaust diverter through the contaminated air exhaust. The air pushes on the flexible diaphragm, which contacts a seating surface around the inlet, preventing the air from exiting the exhaust diverter through the inlet. The remaining air in the system passes into the expansion tank and is diffused, causing any contaminates in the air to fall to the bottom of the expansion tank. The exhaust air is also subjected to a turbulent air flow path in the expansion tank that further separate any contaminants from the air. The remaining air is then vented to the atmosphere through the solenoid drain.

11 Claims, 4 Drawing Sheets

SYRUP DELIVERY SYSTEM

BACKGROUND OF THE INVENTION

Syrup delivery systems are employed to deliver syrup which flavors milkshakes and other frozen desserts. The syrup is delivered from the syrup delivery system to a mixing chamber for mixing with softened ice cream. The syrup and the ice cream mixture is then dispensed from the mixing chamber and served.

Solenoids are commonly employed in syrup delivery systems to control the air flow from an air compressor to a syrup valve that distributes the syrup. When serving the frozen dessert, a user presses a button to open the solenoid. The air compressor generates air pressure. The solenoid opens to send the air pressure from the air compressor to the syrup valve. The air travels from the solenoid through tubing and enters an inlet of a syrup valve. The air moves a plunger in the syrup valve away from the syrup valve tip, allowing syrup from a syrup source to dispense through the syrup valve. The syrup then mixes with the ice cream in the mixing chamber to produce the milkshake or the frozen dessert.

After syrup delivery is complete, the system is turned off, and the solenoid stops air flow from the compressor. The air travels from the syrup valve to the solenoid for venting to the atmosphere through a solenoid drain through a solenoid exhaust port.

A drawback to the prior art syrup delivery system is that the return air from the syrup valve follows the same path as the supply air to the syrup valve. The return air from the syrup valve can be contaminated with syrup particles and become sticky. These syrup particles can build up in the solenoid and cause clogging. Over time, the solenoid may need to be replaced.

Hence, there is a need in the art for a syrup delivery system that reduces the contamination and replacement of the solenoid.

SUMMARY OF THE INVENTION

A syrup delivery system provides syrup which flavors a milkshake or frozen dessert. When the system is turned on, a solenoid is opened and introduces air from an air compressor into an expansion tank. The air travels through tubing and enters an exhaust diverter through an inlet.

The air pushes on a first side of a flexible diaphragm in the exhaust diverter, removing the first side from contact with an annular outer sealing surface around the inlet. Air flows around the flexible diaphragm and exits through the outlet for entry into a syrup valve. The syrup valve dispenses the syrup for mixing with ice cream in a mixing chamber.

After dispensing of the syrup is complete, the solenoid closes, preventing air from entering the system. The exhaust air between the syrup valve and the exhaust diverter flows through the tubing and reenters the exhaust diverter through the outlet. The air pushes on a second side of the flexible diaphragm, removing the second side from contact with an annular inner sealing surface around the contaminated air exhaust. The air exits the exhaust diverter through the contaminated air exhaust and into the atmosphere. Air does not escape through the inlet as the air pushing on the second side of the flexible diaphragm presses the flexible diaphragm against the annular outer sealing surface, preventing air from entering the solenoid.

The remaining air in the system returns to the expansion tank. The air exiting the smaller diameter tubing enters into the larger volume expansion tank and is subjected to a reduction in velocity, causing any contaminates in the air to fall to the bottom of the expansion tank. The exhaust air passing through the expansion tank is then subjected to a turbulent air flow path to further separate any contaminants from the air. The remaining air is then vented to the atmosphere through the solenoid drain.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawing that accompany the detailed description can be briefly described as follows.

DETAILED DESCRIPTION OF THE PREFERRED EMBODIMENT

Figure 1:
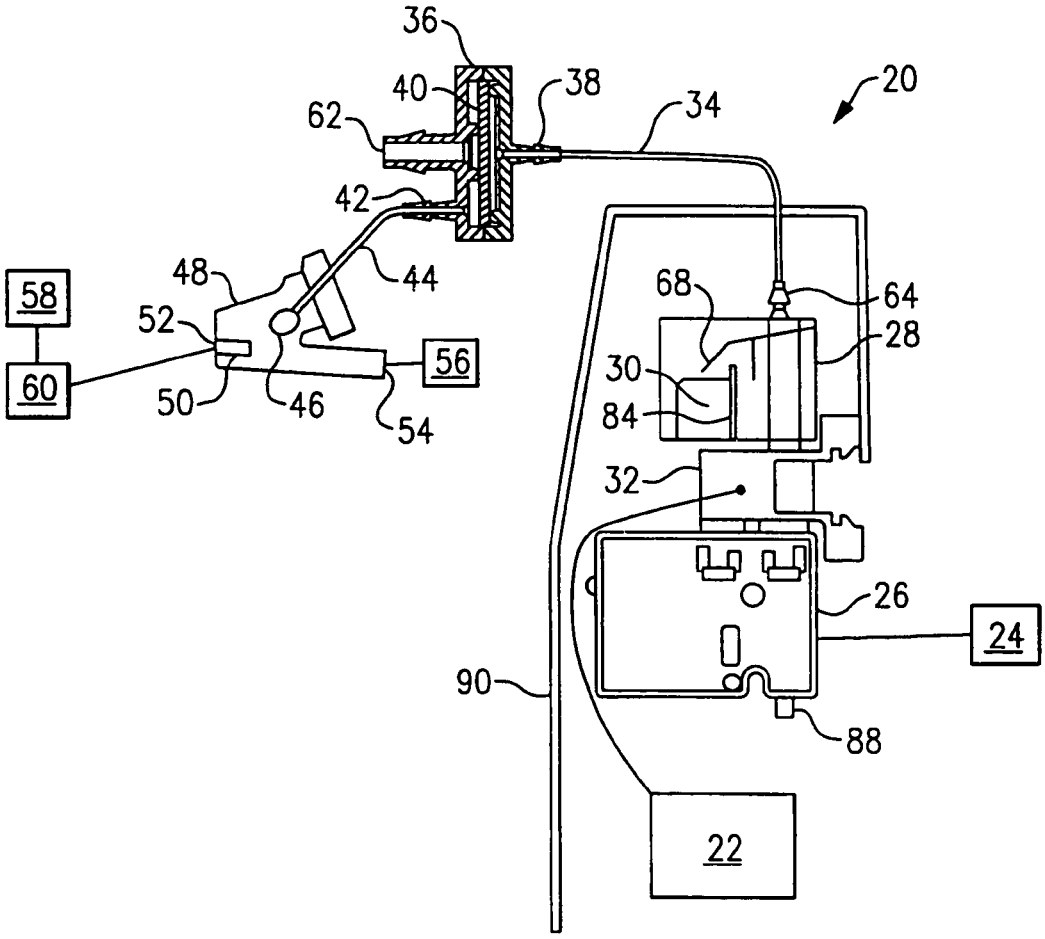
FIG. 1 schematically illustrates a syrup delivery system.

FIG. 1 schematically illustrates the syrup delivery system 20 of the present invention. When the system 20 is turned on by activating a controller 24, a solenoid 26 is opened and introduces air from an air compressor 22 into an expansion tank 28. The controller 24 can be a button manually pushed by an operator. The solenoid 26 is an electric switch which controls the air flow from the air compressor 22 and into the system 20. The solenoid 26 and the expansion tank 28 are connected by a manifold 32, which allows for the quick connection and disconnection of the expansion tank 28 from the solenoid 26. Although a solenoid 26 has been illustrated and described, it is to be understood that the flow of air pressure can be controlled by a manual valve or another type of control.

Figure 2:
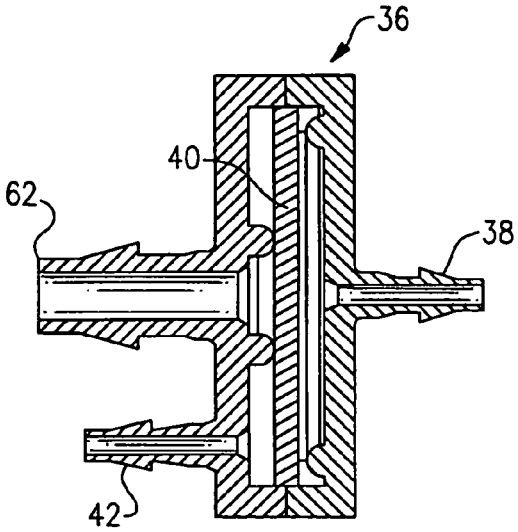
FIG. 2 schematically illustrates a cross sectional side view of the exhaust diverter.
Figure 3:
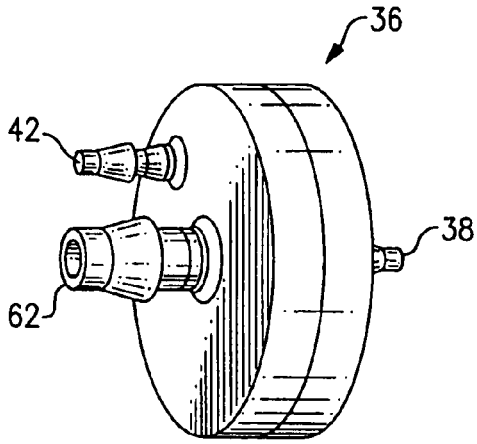
FIG. 3 schematically illustrates a perspective view of the exhaust diverter.

As further shown by FIGS. 2 and 3, after flowing through the expansion tank 28, the air travels through tubing 34 and enters an exhaust diverter 36 through an inlet 38. The exhaust diverter 36 includes a flexible diaphragm 40. When the system 20 is on, the flexible diaphragm 40 directs the air out of the exhaust diverter 36 and through an outlet 42. When the system 20 is off, the flexible diaphragm 40 directs air out of the exhaust diverter 36 through a contaminated air exhaust 62.

Figure 4:
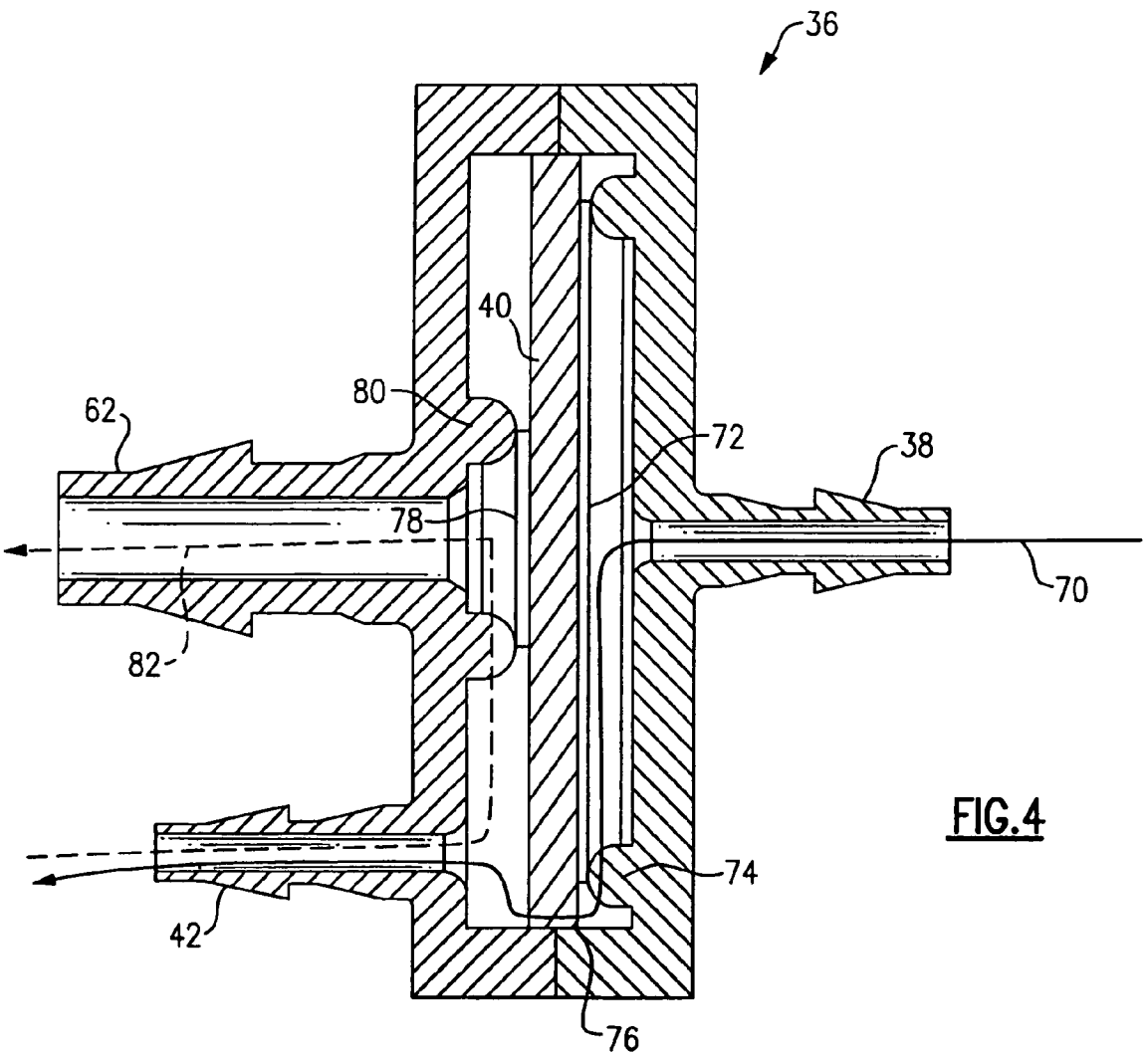
FIG. 4 schematically illustrates a cross sectional side view of the exhaust diverter showing the flow of air.

FIG. 4 illustrates the flow of the air through the exhaust diverter 36. When the system 20 is on, air from the air compressor 22 (shown by solid line 70) enters the exhaust diverter 36 through the inlet 38. The air pushes on a first side 72 of the flexible diaphragm 40, removing the first side 72 from contact with an annular outer sealing surface 74. Air flows around the outer edge 76 of the flexible diaphragm 40 and through the outlet 42. Air does not escape through the contaminated air exhaust 62 as the second side of the flexible diaphragm 40 contacts an annular inner sealing surface 80 located around the contaminated air exhaust 62 to provide a seal.

Returning to FIG. 1, the air exiting the exhaust diverter 36 through the outlet 42 travels through tubing 44 for entry into an inlet 46 of a syrup valve 48. The air moves a plunger 50 in the syrup valve 48 away from the syrup valve tip 52, allowing syrup which enters the syrup valve 48 through an inlet 54 from a syrup source 56 to dispense from the syrup valve tip 52. The syrup from the syrup valve 48 mixes with ice cream from an ice cream source 58 in a mixing chamber 60 for mixing and serving.

As shown in FIG. 4, when the system 20 is turned off to stop the dispensing of syrup from the syrup valve 48, the solenoid 26 closes to prevent air from the air compressor 22 from entering the system 20. The exhaust air between the syrup valve 48 and the exhaust diverter 36 flows through the tubing 44 (shown by dashed line 82) and reenters the exhaust diverter 36 through the outlet 42.

The air pushes on the second side 78 of the flexible diaphragm 40, removing the second side 78 from contact with the inner sealing surface 80. Most of the air in the system 20 flows over the second side 78 of the flexible diaphragm 40 and through the contaminated air exhaust 62 for venting to the atmosphere. Any contaminates in the air is also vented to the atmosphere. Preferably, approximately 90% of the air in the system 20 is vented to the atmosphere through the contaminated air exhaust 62. Air does not escape through the inlet 38 of the exhaust diverter as the first side 72 of the flexible diaphragm 40 contacts the annular outer sealing surface 74 located around the inlet 38 to provide a seal.

Figure 5:
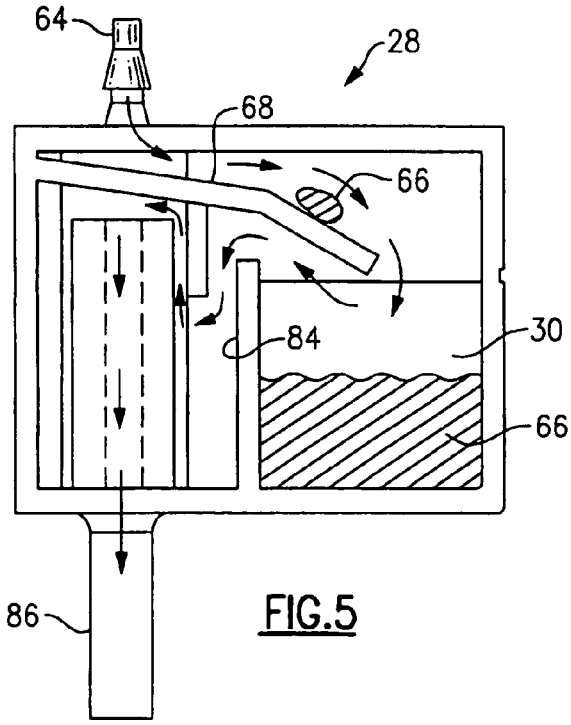
FIG. 5 schematically illustrates the expansion tank.

As shown in FIG. 5, the remaining the air in the system 20 passes into the expansion tank 28 through a first opening 64. This air may also contain contaminates. The air exits the smaller diameter tubing 34 and enters into the larger volume expansion tank 28, dropping the air pressure and diffusing the air. The reduction in volume causes any contaminates 66 to fall out of the air. The contaminates 66 in the air drop and travel along a ramp 68 and fall to the bottom of a collection tank 30. The collection tank 30 accumulates the syrup that is not captured by the exhaust diverter 36 and prevents any contaminants from entering the solenoid 26. The collection tank 30 is preferably made of a transparent or translucent material so the level of contaminates in the collection tank 30 can be easily read. Once the collection tank 30 is filled, the collection tank 30 is replaced. Although a collection tank 30 has been illustrated and described, it is to be understood that the expansion tank 28 can include a drain hole that drains the contaminates.

As shown by the arrows in FIG. 5, the exhaust air is then subjected to a turbulent air flow path created by walls 84 in the expansion tank 28. The turbulence further separates any contaminants from the air. The remaining air is then exhausted from the expansion tank 28 through a second opening 86 to the solenoid 26 and vented to the atmosphere through the solenoid drain 88. The walls 84 of the expansion tank 28 can also include a surface designed to allow adhesion of the contaminates for additional removal from the airflow.

Therefore, when the system 20 is turned off, the air located between the exhaust diverter 36 and the syrup valve 48 is vented to the atmosphere through the contaminated air exhaust 62 of the exhaust diverter 36, and the air located between the exhaust diverter 36 and the solenoid 26 is vented to the atmosphere through the solenoid 26. The exhaust diverter 36 exhausts contaminated air out of the system 20 prior to returning the air to the solenoid 26, minimizing the amount of contaminated air that returns to the solenoid 26 which can cause contamination and malfunctions. If the contaminated air returned to the solenoid 26, the contaminants could clog the solenoid 26, causing malfunctions and replacement. Rather, the contamination from the air are exhausted through the exhaust diverter 36. if the exhaust diverter 36 becomes contaminated and malfunctions, the exhaust diverter 36 is easily replaced.

Preferably, a manifold shield 90 is positioned over the expansion tank 28 and the solenoid 26 to protect the syrup delivery enhancement system 20 from external contamination and spillage.

Figure 6:
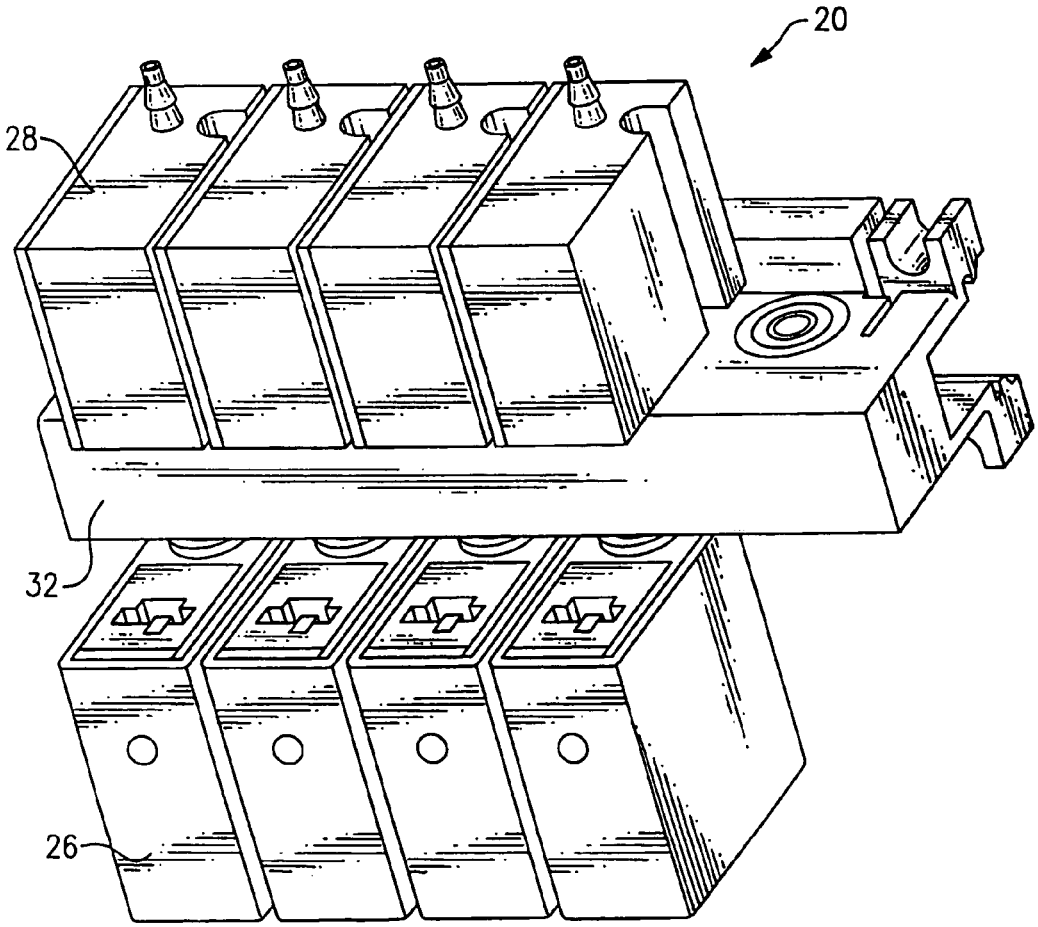
FIG. 6 schematically illustrates four syrup delivery systems.

Although only one syrup delivery system 20 is illustrated and described, it is to be understood that any number of syrup delivery systems 20 can be employed. In one example, four syrup delivery systems 20 are employed. In this example, as shown in FIG. 6, four expansion tanks 28 and four solenoids 26 are positioned side by side as shown in FIG. 4 on the manifold 32. Each expansion tank 28/solenoid 26 set can be used for a different flavor.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A fluid delivery system comprising:

a valve having a inlet, and an outlet, and a contaminated air exhaust, wherein a supply air enters said valve through said inlet and exists said valve through said outlet when said system is active;

a fluid dispensing valve, wherein said supply air from said outlet of said valve actuates said fluid dispensing valve to dispense a fluid, and return air from said fluid dispensing valve entering said valve through said outlet and exits said valve through said contaminated air exhaust when the system is inactive;

a control that regulates introduction of said supply air into the system, wherein said control is a solenoid; and an expansion device located between said solenoid and said valve, and said supply air flowing between said valve and said solenoid enters said expansion device and is reduced in velocity to separate said fluid form said supply air.

2. The system as recited in claim 1 wherein said valve includes a flexible diaphragm, and said flexible diaphragm blocks said contaminated air exhaust when said supply air flows into said valve through said inlet and said flexible diaphragm blocks said inlet when said return air flows into said valve through said outlet.

3. The system as recited in claim 2 wherein said supply air pushes said flexible diaphragm against said contaminated air exhaust when said supply air enters said valve and said return air pushes said flexible diaphragm against said inlet when said return air enters said valve.

4. The system as recited in claim 1 wherein said solenoid includes a solenoid exhaust, and said supply air flowing between said solenoid and said valve exits the system through said solenoid exhaust when the system is inactive.

5. The system as recited in claim 1 further including an expansion tank in said expansion device, wherein said fluid collects in said expansion tank.

6. The system as recited in claim 5 wherein said expansion tank is removable from said expansion device.

7. The system as recited in claim 5 wherein said supply air is subjected to turbulence in said expansion tank to further separate said fluid from said supply air.

8. The system as recited in claim 1 further including an air compressor that generates said supply air.

9. A fluid delivery system comprising:

an air compressor to generate supply air;

a solenoid to control introduction of said supply air into the system;

a valve including a flexible diaphragm, an inlet, an outlet, and a contaminated air exhaust, wherein said supply air enters said valve through said inlet and exits said valve through said outlet when said system active, and wherein said flexible diaphragm blocks said contaminated air exhaust when said supply air flows into said valve through said inlet;

a fluid dispensing valve, wherein said supply air flowing from said outlet of said valve actuating said fluid dispensing valve to dispense a fluid, and a return air flowing from said fluid dispensing valve enters said valve through said outlet and exits said valve through said contaminated air exhaust when said system is inactive, and wherein said flexible diagraph blocks said inlet when said return air flows into said valve through said outlet; and an expansion device located between said solenoid and said valve, and said supply air flowing between said valve and said solenoid enters said expansion device and undergoes a pressure drop to further separate said fluid from said supply air.

10. The fluid delivery system as recited in claim 9 further including an expansion tank in said expansion device, wherein said supply air is subjected to turbulence in said expansion tank to further separate said fluid from said supply air.

11. The fluid delivery system as recited in claim 9 further including a mixing chamber, wherein said fluid from said fluid dispensing valve flows into said mixing chamber and mixes with a frozen product in said mixing chamber to form a frozen dessert.

* * * * *

UNITED STATES PATENT AND TRADEMARK OFFICE

CERTIFICATE OF CORRECTION

PATENT NO. : 7,014,076 B2
APPLICATION NO. : 10/272233
DATED : March 21, 2006
INVENTOR(S) : Minard, James J. et al.

It is certified that error appears in the above-identified patent and that said Letters Patent is hereby corrected as shown below:

Column 4:

Line 33: delete second occurrence of "a" and insert --an--

Line 48: delete "form" and insert --from--

Signed and Sealed this

Twenty-second Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,014,076 B2
APPLICATION NO. : 10/272233
DATED : March 21, 2006
INVENTOR(S) : Minard, James J. et al.

It is certified that error appears in the above-identified patent and that said Letters Patent is hereby corrected as shown below:

Column 4:

Line 33: delete second occurrence of “a” and insert --an--

Line 48: delete “form” and insert --from--

Signed and Sealed this

Twelfth Day of September, 2006

JON W. DUDAS
*Director of the United States Patent and Trademark Office*